US008549820B2

(12) United States Patent
Falise et al.

(10) Patent No.: US 8,549,820 B2
(45) Date of Patent: Oct. 8, 2013

(54) PACKAGING DEVICE AND PACKAGING PROCESS

(75) Inventors: Dirk Falise, Kaufering (DE); Norbert Sauerwein, Augsburg (DE)

(73) Assignee: Hi Tech Textile Holding GmbH, Leonding (AT)

( * ) Notice: Subject to any disclaimer, the term of this patent is extended or adjusted under 35 U.S.C. 154(b) by 372 days.

(21) Appl. No.: 12/922,914

(22) PCT Filed: Mar. 18, 2009

(86) PCT No.: PCT/EP2009/002004

§ 371 (c)(1),
(2), (4) Date: Sep. 16, 2010

(87) PCT Pub. No.: WO2009/115314

PCT Pub. Date: Sep. 24, 2009

(65) Prior Publication Data

US 2011/0011036 A1 Jan. 20, 2011

(30) Foreign Application Priority Data

Mar. 18, 2008 (DE) ..... 20 2008 003 760 U

(51) Int. Cl.
*B65B 11/58* (2006.01)
*B65B 27/12* (2006.01)
*B65B 9/14* (2006.01)

(52) U.S. Cl.
USPC ..... 53/399; 53/438; 53/441; 53/449; 53/459; 53/529; 53/176; 53/556; 53/567

(58) Field of Classification Search
CPC ..... B65B 27/125; B65B 9/13; B65B 9/14; B65B 27/12; B65B 11/58
USPC ..... 53/399, 438, 441, 449, 459, 176, 529, 53/556, 567, 576, 577
IPC ..... B65B 9/14,11/58, 27/12
See application file for complete search history.

(56) References Cited

U.S. PATENT DOCUMENTS

| | | | | | |
|---|---|---|---|---|---|
| 214,282 | A | * | 4/1879 | Dederick | 53/438 |
| 3,584,428 | A | * | 6/1971 | Falk | 53/438 |
| 3,778,960 | A | * | 12/1973 | Christensen et al. | 53/459 |
| 3,897,674 | A | * | 8/1975 | Higgins | 53/567 |

(Continued)

FOREIGN PATENT DOCUMENTS

| | | |
|---|---|---|
| DE | 1 976 173 | 12/1967 |
| DE | 19 51 113 | 4/1971 |

(Continued)

OTHER PUBLICATIONS

EPO machine translation EP0695690 from Espacenet.com, retrieved Nov. 24, 2012, 7 pages.*

*Primary Examiner* — Stephen F Gerrity
(74) *Attorney, Agent, or Firm* — McGlew and Tuttle, P.C.

(57) ABSTRACT

A packaging device is provided for highly-compacted compressed bales (2), which are provided with a fixation (3). The packaging device (1) has a sheathing device (16) for applying a shrink wrapping, which has at least one prepared and diverted stretching hood (4), to the compressed bales (2). A bale compression facility is also provided having at least one bale press (6) for generating highly compacted compressed bales (2), which are provided with a fixation (3), and having at least one packaging device (1) according to the invention. A process is provided for packaging highly-compacted compressed bales (2), which are provided with a fixation (3), wherein said compressed bale (2) is provided with a shrink wrapping, wherein at least one prepared and diverted stretching hood (4) is applied to said compressed bale (2) using a sheathing device (16).

38 Claims, 6 Drawing Sheets

(56) References Cited

U.S. PATENT DOCUMENTS

| | | | | | |
|---|---|---|---|---|---|
| 3,961,459 | A | | 6/1976 | Wolske | |
| 4,050,219 | A | * | 9/1977 | Higgins | 53/567 |
| 4,060,957 | A | * | 12/1977 | Birkenfeld et al. | 53/449 |
| 4,300,327 | A | | 11/1981 | Bridger | |
| 4,724,652 | A | * | 2/1988 | Birkenfeld | 53/567 |
| 5,385,002 | A | | 1/1995 | Cundall | |
| 5,423,161 | A | * | 6/1995 | Huson et al. | 53/449 |
| 5,628,168 | A | | 5/1997 | Inman et al. | |
| 5,799,466 | A | * | 9/1998 | Underhill | 53/399 |
| 2004/0237810 | A1 | * | 12/2004 | de Baat | 100/218 |

FOREIGN PATENT DOCUMENTS

| | | | | |
|---|---|---|---|---|
| DE | 34 32 832 | | | 3/1986 |
| DE | 3908957 | A1 | * | 9/1990 |
| DE | 39 41 139 | | | 6/1991 |
| DE | 40 15642 | | | 11/1991 |
| DE | 42 35 409 | | | 1/1994 |
| DE | 4440217 | C1 | * | 5/1996 |
| DE | 196 45 640 | | | 5/1997 |
| DE | 693 25 717 | | | 3/2000 |
| DE | 201 04 960 | U1 | | 5/2003 |
| EP | 0 344 815 | | | 12/1989 |
| EP | 0 695 690 Al | | | 2/1996 |
| EP | 1 120 237 | | | 8/2001 |
| WO | WO 88/09748 | | | 12/1988 |
| WO | WO 97/27008 | | | 6/1997 |
| WO | WO 2005/042346 | | | 5/2005 |

* cited by examiner

PACKAGING DEVICE AND PACKAGING PROCESS

CROSS REFERENCE TO RELATED APPLICATIONS

This application is a United States National Phase application of International Application PCT/EP2009/002004 filed Mar. 18, 2009, and claims the benefit of priority under 35 U.S.C. §119 of German Patent Application 20 2008 003 760.3 filed Mar. 18, 2008, the entire contents of which are incorporated herein by reference.

FIELD OF THE INVENTION

The present invention pertains to a packaging device and a packaging process.

BACKGROUND OF THE INVENTION

It is known from WO 88/09748 A1 and DE 40 15 642 A1 that a pressed bale can be packaged within a baling press and fixed by strapping. The packaging comprises a bottom film and a cover film, which are wrapped around and put on the bale. In addition, a body belt may be applied as well. This film packaging is located, as a rule, under the strapping. The packaging and strapping are applied at a point in time at which the pressed bale is still being clamped, which bales are under a very high pressure of, e.g., several hundred tons between press punches. Such pressed bales have a very high compaction and tend to expand after being released. The packaging and fixation must be correspondingly stable.

It is known from DE 19 51 113 A1 that the above-mentioned film packaging with two or three films can be replaced with two bags consisting of a flexible and weldable plastic. The material of the bale is inserted here into the bags pulled one over the other and compacted with high pressure in the bags. The bags are welded together at the overlapping points in the area of the lower press punch. The pressed bale and bag packaging are subsequently strapped. The packaging must take place within the baling press in this case as well. The bags are adapted to the shape of the bale and consist of a dimensionally stable material, and one of the bags must be inflated with compressed air for the filling and pressing operation.

SUMMARY OF THE INVENTION

The object of the present invention is to show an improved packaging technique. This object is accomplished by the present invention with the features in the principal process claim and in the principal device claim. The packaging technique being claimed has the advantage that the packaging of the bale can be carried out after the fixation thereof, for example, by applying a strapping. The shrink packaging with the expansion cap may thus optionally take place within or outside a baling press. In addition, a plurality of baling presses may have one or a plurality of shared packaging device. The bales can be highly compacted and compressed, e.g., with pressing forces of several hundred tons.

The expansion cap prepared in advance is placed over the fixed bale and comes tightly into contact with the surface of the bale during shrinking due to the elastic properties of the cap material. The expansion cap is tentered and possibly reefed. If can subsequently be pulled, with its bottom pointing forward, over the bale, and it is folded over and turned from the inside to the outside and rolls on the bale. This is an especially favorable application technique. A possibly outer bottom seam can be brought by turning into a protected inner position at the bale. The expansion cap may be shorter than the bale length, the bale extending through the opening of the expansion cap.

The expansion cap may lie on the outside on a fixing means or strapping, which leads to advantages during the subsequent opening of the packaging and of the strapping and can prevent the strapping bands, which are under high pressure, from opening up.

The pressed bale may be surrounded by an envelope that is tight all around by means of one or more expansion caps. Tight wrapping or packaging of the pressed bale offering protection against environmental effects is obtained due to the overlapping arrangement of the expansion caps and of a possibly other partial envelope. An additional fixation of the one or more expansion caps to one another or to the bale may be dispensable.

The packaging technique has various economic advantages. On the one hand, the design effort needed for the packaging device can be reduced compared to conventional constructions, and maximum load of a packaging device intended for a plurality of baling presses can also be achieved. In addition, cost-effective materials, especially elastic stretch films made of polyethylene, which are cheaper than other packaging films, can be used for the expansion caps.

If different bale materials are processed in a baling press or in a baling press plant, problems may arise due to entrainment of material and contamination associated therewith, with mixing of the material of the pressed bales. The present invention makes provisions for counteracting this phenomenon with suitable means in the feed area between the baling press and the packaging device. This is possible in various ways. Any material entrained can be removed with a suitable cleaning technique, e.g., by brushing, vacuuming or the like with a cleaning device in the feed area and especially in the area of the conveyors. As an alternative, bale carriers intended for specific materials can be used. An especially favorable possibility is the arrangement of a prepackaging device in the area of the press. This can apply a partial envelope before or during the fixation of the pressed bale. A bottom film may be applied here especially during the preparation of the pressed bale, wrapped laterally around a partial area of the pressed bale and subsequently fixed with a strapping. The bottom film prevents removal of bale material and hence entrainment of material. In addition, the partial enveloping may already form a first essential component of the overall package, so that it may be sufficient to subsequently apply to the pressed bale only an expansion cap, which overlaps the existing partial envelope.

If a pressed bale is to be packaged into expansion caps only, the packaging device may have a turning means in order to make it possible to apply expansion caps onto the pressed bale from different sides and pull them over.

The packaging of a pressed bale with two expansion caps, which are arranged, e.g., on opposite sides of the bale and outside the fixation, has special advantages. The overlapping site of the expansion caps is especially tight and securely protects the bale from external effects such as moisture, dampness, dust, etc. Small fibers or other small parts of the bale also cannot fall out, which especially prevents mixing of bale materials and guarantees that the packaged bale will consist of the same kind of material during its transportation and storage as well. When unpacking the bale, the expansion caps can be removed very easily separately and prior to fixation, without remnants of packaging material remaining on the pressed bale. Contamination of the material of the pressed bale by the packaging material is also ruled out hereby.

The pull-over means can at first stretch an expansion cap to an excess and pull it over the pressed bale on at least three sides by moving over the pressed bale and by means of a rolling operation. The elastically shrinking expansion cap material comes tightly into contact with the bale surface during pulling over. The expansion cap can be manufactured by means of a suitable manufacturing device within the packaging device from a tubing in an especially cost-effective manner. The dimensions of the cap can be varied for adaptation to different bale formats.

The packaging technique according to the present invention may be used in new baling presses or baling press plants. It may also be used to retrofit existing baling presses and baling press plants and replace existing packaging device. The bale logistics may also be changed in order to change over from a press-based bale packaging to a central bale packaging, The cost benefits associated with the packaging technique according to the present invention cover the investment cost.

Further advantageous embodiments of the present invention are described in the subclaims.

The present invention is schematically shown in the drawings as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
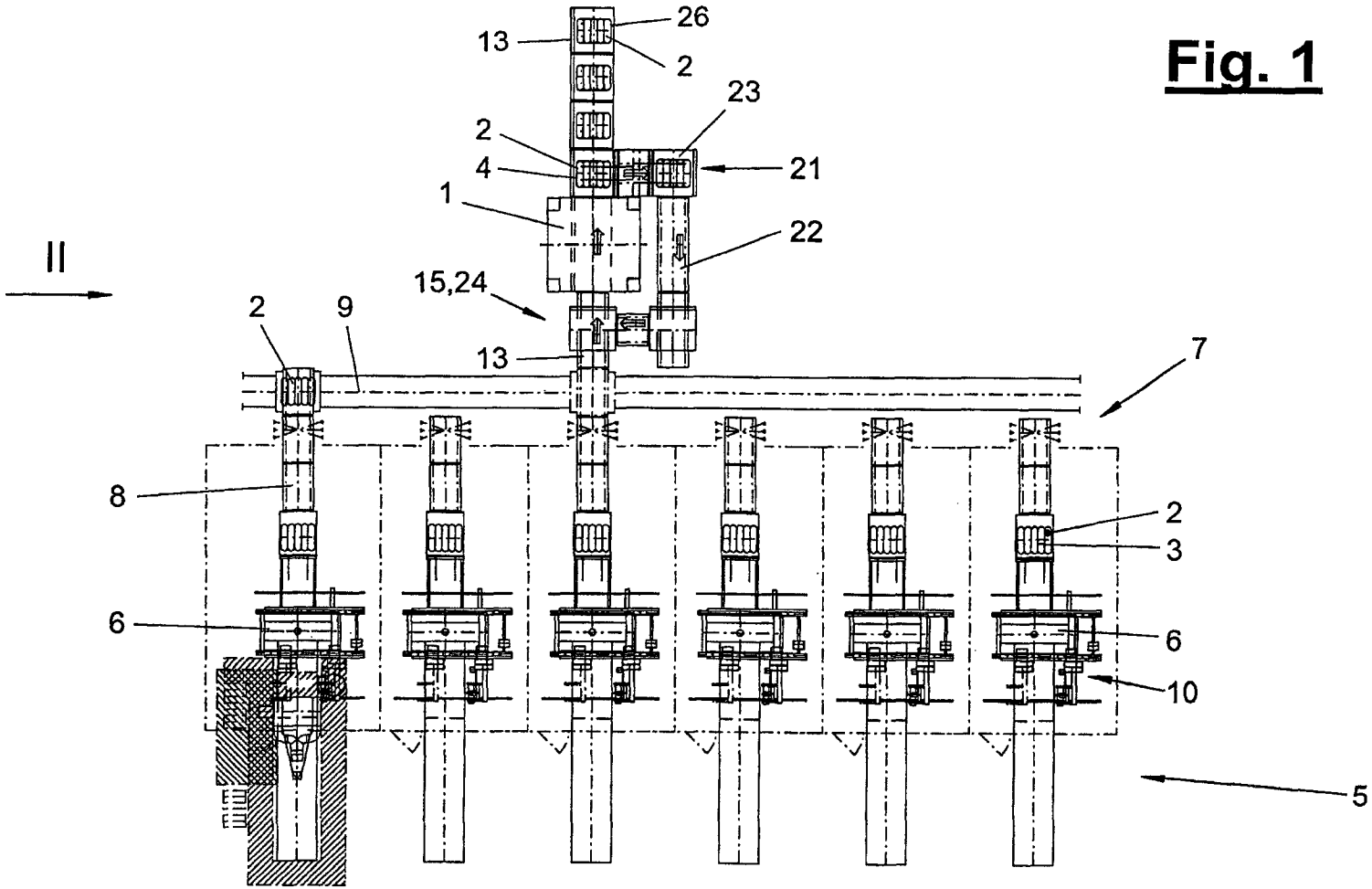
FIG. 1 is a top schematic view of a baling press plant with a plurality of baling presses and with a common packaging device.

Referring to the drawings in particular, the present invention pertains to a packaging device (1) and to a packaging process for highly compacted pressed bales (2). The present invention pertains, furthermore, to a baling press (6) equipped with at least one such packaging device (1) or to a baling press plant (5) with one or more baling presses (6).

In a schematic exemplary embodiment, FIG. 1 shows a baling press plant (5), which has a plurality of baling presses (6) arranged next to each other in a row. Pressed bales (2) are prepared and compacted in the baling presses between press punches under a very high pressure and with pressing forces of, e.g., 300 tons to 500 tons.

Different materials are considered for use as baling materials. These may be, e.g., fiber materials, especially synthetic fibers in the cut form, so-called staple fibers or in a longer form as so-called tow. As an alternative, the bale material may consist of natural fibers, e.g., cotton or the like in the cut form or in a long form. Cellulose is also suitable. Furthermore, wastes, e.g., textile wastes from an opener, but also other materials, preferably small parts, may be used as well. These may also be plant materials.

The bale material is compacted in the baling press (6) and shaped into a pressed bale (2). The baling presses (6) may be designed as vertical or horizontal presses for this in any desired and suitable manner, e.g., corresponding to DE 34 32 832 A1, EP 1 120 237 A2 or WO 88/09748 A1.

The highly compacted pressed bales (2) may be provided with a fixing means (3), which imparts to them a permanent shape and prevents the released pressed bales (2) from opening up before the subsequent packaging. The fixing means (3) may comprise, e.g., one or more strappings with plastic or steel bands, which are wound around the pressed bale (2) during the bale pressing. As an alternative, other fixing means are possible as well. The fixing means (3) may be arranged, in addition, optionally within the baling press (6) or on the outside with a corresponding auxiliary means.

In the embodiment being shown, the baling presses (6) are connected via a conveying means (7) to a common packaging device (1). In a variant of the embodiment being shown, each baling press (6) may have a packaging device (1) of its own. Furthermore, press groups, with which a packaging device (1) each is associated, may also be formed within the baling press plant (5). In the embodiment shown and in the above-mentioned variants, the packaging device (1) is arranged outside the one or more baling presses (6). In another variant, the packaging device (1) may also be integrated within a baling press (6), in which case the baling press (6) is designed, e.g., as a rotary press or the like to what is shown in WO 88/09748 A1.

The packaging device (1) applies a shrink wrapping in the form of at least one expansion cap (4) to the pressed bale (2) and has a pull-over means (16) for this. The expansion cap (4) consists of an elastic material, which can again elastically shrink by itself after expansion. The cap material may be, e.g., an elastic plastic, especially a polyethylene. Plastic films made of a long-chain low-density polyethylene, especially LLDPE, are especially favorable. Stretchable plastic films may be used for shrink film wrapping.

If the expansion caps (4) are applied after the fixation outside the baling press (6), the elastic material does not advantageously have to follow the local forces and local expansions occurring during the expansion of the pressed bale during release, which occur especially between the fixing means or strappings (8). The packaging material does not therefore have to have an especially high tensile strength. It is possible to use, for example, inexpensive, thin and homogenous plastic films, which do not have incorporated support fibers or networks.

The expansion cap (4) has a bag-like shape with an opening (32), a closed bottom (33) and a jacket (34), The expansion cap (4) may be manufactured and applied to the pressed bale (2) in any desired and suitable manner. It is preferably formed in the form of a bag cut to length before application to the pressed bale (2), reefed and prestretched and then pulled over the pressed bale (2). The length of the expansion cap (4) may be shorter than the bale length to be covered, so that the pressed bale (2) is not fully surrounded by the expansion cap (4) and protrudes through the opening (32) of the cap.

Figure 3:
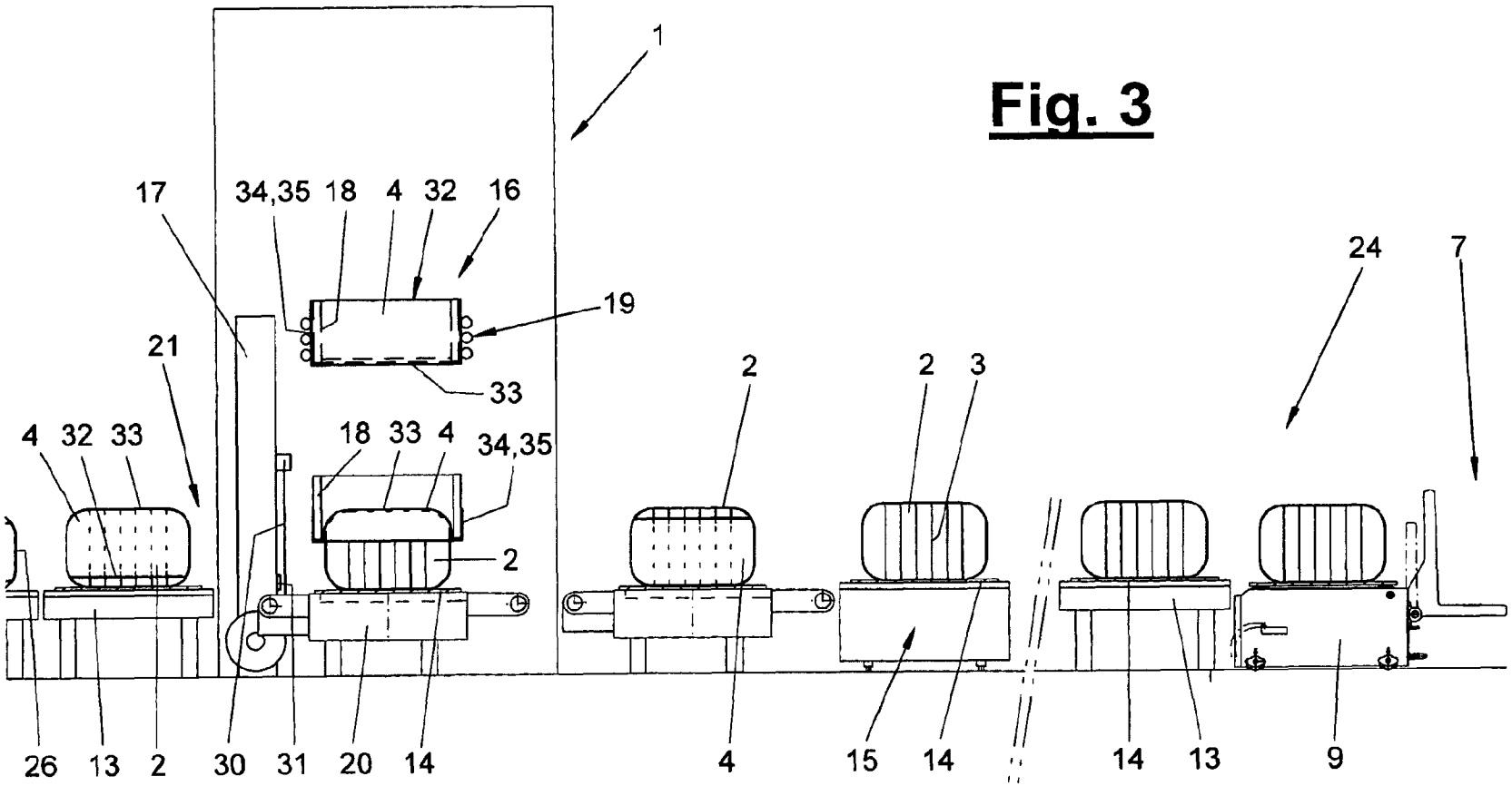
FIG. 3 is a cut-away and enlarged side view of the packaging device in a variation of FIG. 2.
Figure 4:
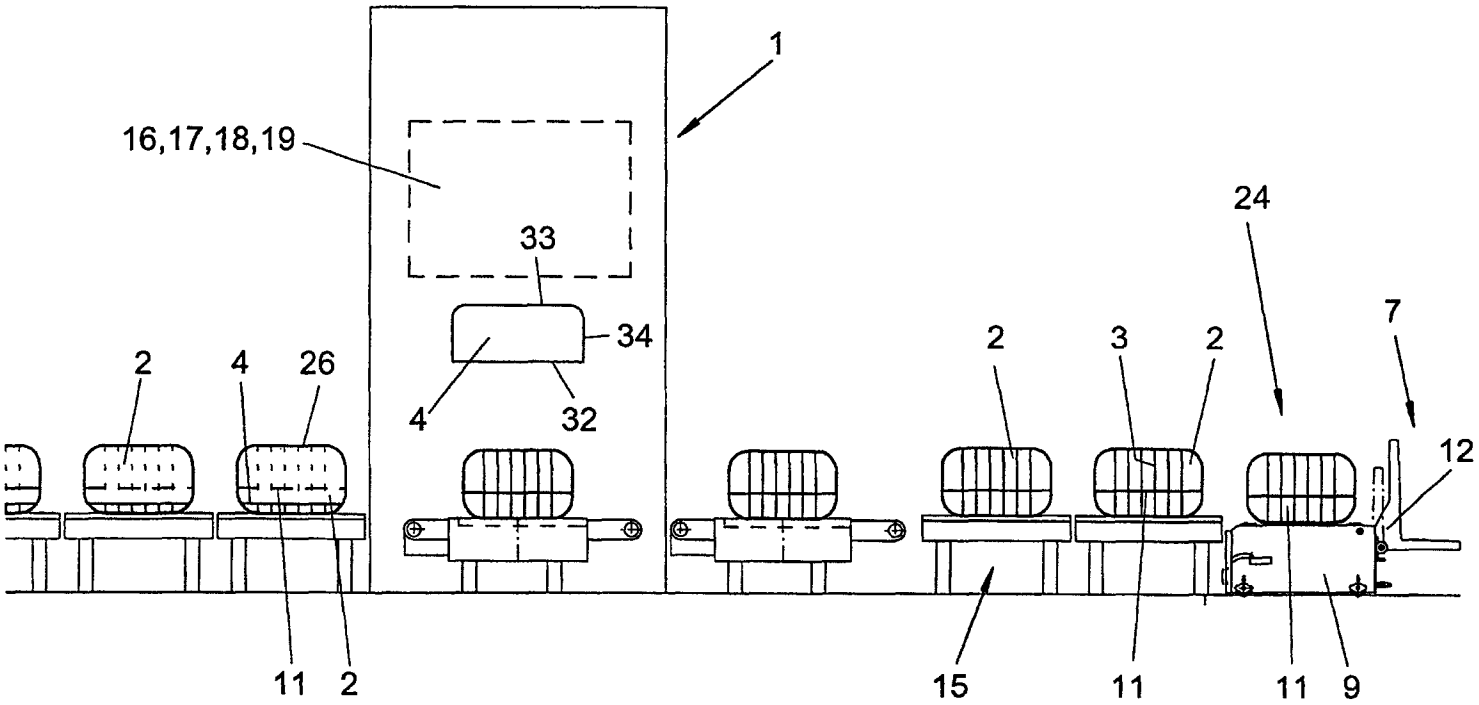
FIG. 4 is a cut-away side view showing another variant of the packaging device.

The usually elongated pressed bale (2) may have any desired and suitable position during the application of the expansion cap (4). This may be, e.g., a horizontal position as is shown in FIGS. 3 and 4 or a position in which it stands on edge according to FIG. 2. Oblique positions are possible as well. The expansion cap (4) and the bale (2) are moved relative to one another, which is possible in various ways. The expansion cap (4) is moved relative to the nonmoving bale (2) in the embodiment being shown, which is brought about, e.g., with a vertical motion.

The packaging device (1) has a bale pickup (20) at the packaging site, which is adapted to the shape and handling requirements of a pressed bale (2) and has sufficient stability. It may be integrated in a conveyor. In addition, a stabilizing means (29), which positions the pressed bale (2) in a predetermined position favorable for packaging and holds same in a stable manner, may be arranged at the bale pickup (20). The stabilizing means (29) can stabilize especially a pressed bale (2) standing upright with its longitudinal axis and secure it against falling over.

The pull-over means (16) is preferably designed such that it expands the prepared expansion cap (4) to an excess and pulls it over the pressed bale (2) standing ready on the bale pickup (20). The expansion cap (4) may now point with the closed bottom (33) towards the bale (2) or downwardly and with the cap opening (32) away from the bale (2) or upwardly, with the expansion cap (4) placed at first on the top side of the bale when it is being pulled over the pressed bale (2) and is subsequently flipped over or turned, rolling on the lateral walls (34) of the cap and laid on the side walls of the bale on bending over. Both the bottom area (33) can be stretched in the horizontal plane and the lateral walls (34) of the cap can be expanded in the vertical direction during the expansion of the cap material. The longitudinal and circumferential expansion of the expansion cap (4) may be set separately and extensively independently from one another.

The pull-over means (16) may be designed, e.g., according to EP 0 344 815 A1 or DE 42 35 409 C1, the expansion cap (4) being directed with the cap opening (32) towards the bale (2) and downwardly. FIG. 4 schematically indicates this variant.

The design and the alignment of the expansion cap (4) may be different in the preferred embodiment shown in FIG. 3. The embodiment of the pull-over means (16), which is shown in a simplified form here, is similar in parts to the design according to the above-mentioned state of the art and has a vertically movable stretching frame (18), whose cross section is adjustable with a reefing means (19). The stretching frame (18) may comprise a plurality of, e.g., four angulated corner parts, which form the corners of the frame and are movable in two directions relative to one another. The expansion cap (4) with its side walls (34) is tentered around these corner parts. On the underside, the corner parts may be connected circumferentially by a tensioning cable, a chain or the like, which forms the rolling edge or turning edge for the side walls (34) of the expansion cap (4) during pulling over. The stretching frame (18) is mounted in a machine frame with corresponding drives such that it is vertically adjustable and laterally adjustable in two directions. The stretching frame may be arranged on a carriage (39), which is movable monoaxially or multiaxially, especially vertically and optionally horizontally.

A reefing means (19) with friction rollers, which pulls up the side walls (34) of the expansion cap (4), folds or reefs it while shortening the jacket length and bring them into the starting position shown in FIG. 3 with the cap opening (32) pointing upward, may be arranged at the stretching frame (18) and especially at the corner parts. The reefing area (35) of the cap jacket (34) is held on the stretching frame (18) above the bottom (33). The bottom (33) of the expansion cap (4) is tightly in contact with the lower edge of the stretching frame (18) in the starting position and is tentered here as a film surface.

FIG. 3 also shows the lowered position, in which the expansion cap (4) is in contact with the top side of the bale and has already been pulled over part of the side walls. The pressed bales (2) are shown rotated in relation to their original position shown in FIG. 1 for the sake of clarity in the side views in FIGS. 2 through 4, so that the fixing means (3) is also visible.

The expansion caps (4) may be prepared and supplied in any desired and suitable manner. In the embodiment being shown, the pull-over means (16) has a manufacturing device (17) for the expansion cap (4), which are formed from a stretch film tubing (30). The cap is formed on the bale (2). The tubing (30), which is open on the front side, is pulled off here upwardly preferably vertically from a coil (36) arranged next to the bale pickup (20) and brought to the intended length, and a cutting and welding means (31, 41, 42) cuts the stretched tubing (30) at its lower end.

The opening of the cut-off piece of tubing (30') is closed at the cutting point with a weld seam or in another suitable manner while forming the bottom (33). The piece of tubing (30'), closed on one side at the bottom, is located under the stretching frame (18) laterally next to the pressed bale (2) and forms the expansion cap (4). The tubing (30) has a circumference and a width that are smaller than the circumference and the width of the pressed bale (2), so that the pulled-over expansion cap (4) is still stretched after shrinking and is elastically and tightly in contact with the pressed bale as a result.

Figure 5:
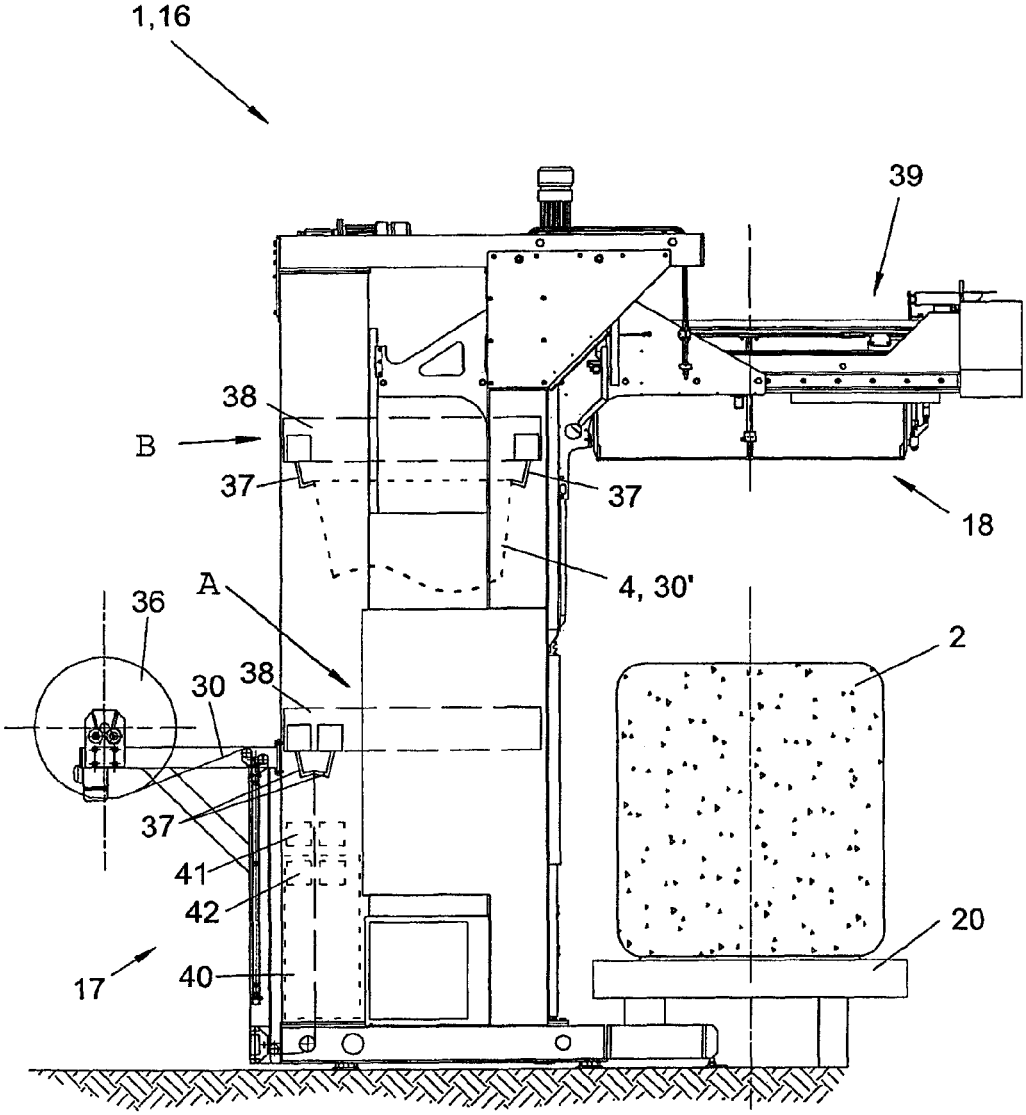
FIG. 5 is a side schematic view of a pull-over means.
Figure 6:
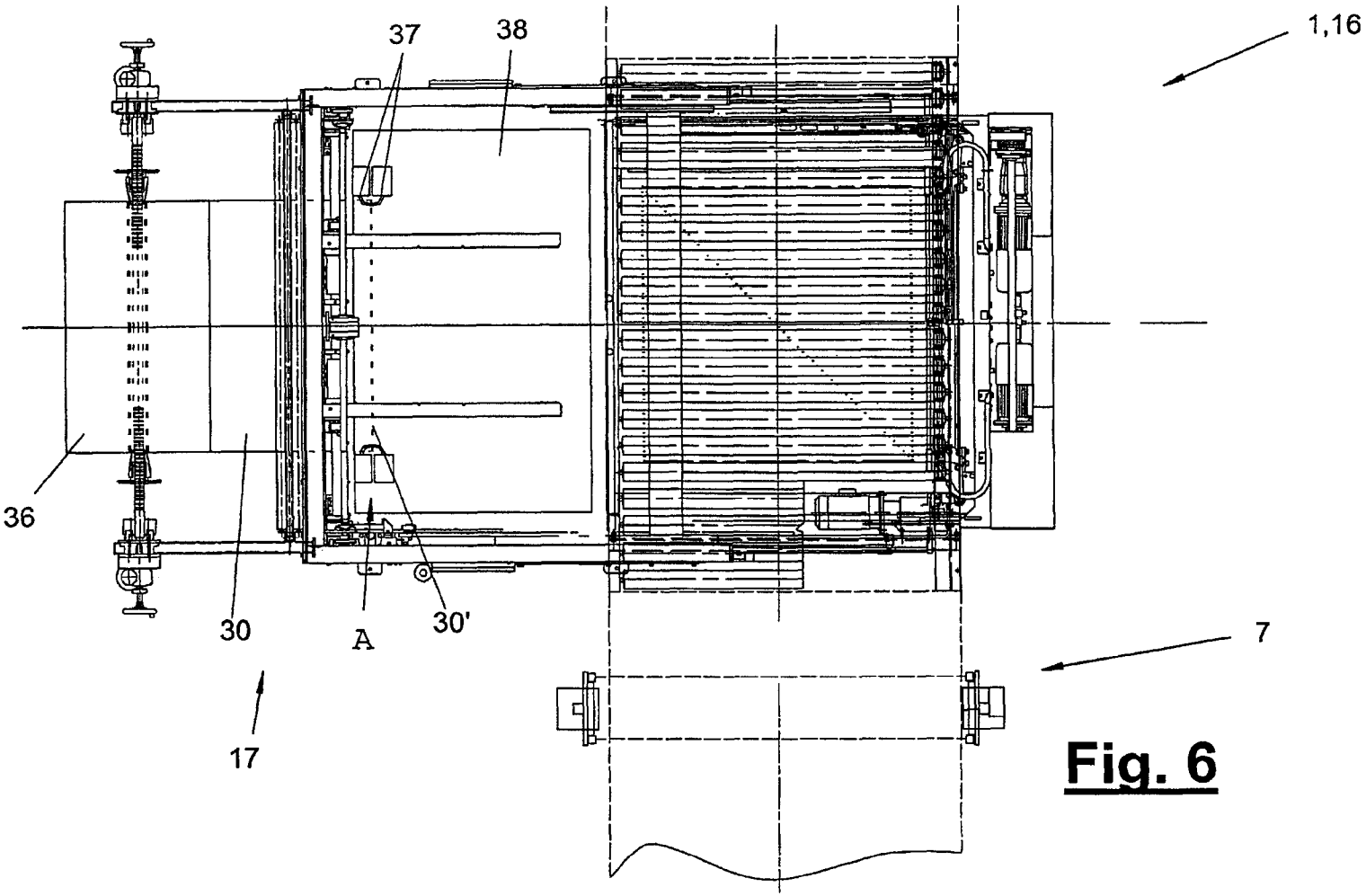
FIG. 6 is a top schematic view of a pull-over means.

The handling of the tubing (30) and of the cut-off piece of tubing (30') is shown as an example in FIGS. 5 and 6. It is preferably carried out by means of a pull-off means (40) combined with a gripping means. The gripping means preferably comprises a plurality of fingers (37), which are arranged on a vertically and horizontally movable carriage (38). The pull-off means (40) delivers the free end of a tubing (30) located on the coil (36) into the access area of the gripping means. A cutting or severing means (41) and a welding means (42) are preferably arranged at the pull-off means (40). The open end of the tubing (30) or of the cut-off piece of tubing (30') is picked up in the pull-off position (A) by the fingers (37) in a position in which they are moved up to one another. The tubing may be cut off already within the pull-off means (40) or only after it has been pulled out to a suitable length, after which the piece of tubing (30') is formed. The piece of tubing (30') is closed preferably after cutting off at the lower end by the welding means (42).

The manufacturing device (17) pulls apart the upper opening of the tubing at the transition from the pull-off position (A) to the feed position (B) with preferably four advanced fingers (37) and forms an expansion cap opening (32) corresponding in cross section to the contour of the closed stretching frame (18). The fingers (37) subsequently transfer the opened expansion cap (4) from the bottom to the introduced stretching frame (18), while the expansion cap (4) or the piece of tubing (30') fills with air, is blown up and unfolds. The stretching frame (18) and/or a carriage (38) with the fingers (37) can perform lateral motions and lifting motions. The transferred expansion cap (4) with the reefing means (19) on the outside is taken up at the stretching frame (18) and folded in a bag-like manner at the side wall of the stretching frame (18) and then stretched further to the dimension needed for pulling over by spreading the stretching frame (18). The inner surface of the spread stretching frame (18) is somewhat larger than the front surface of the bale.

The expansion cap (4) points with its bottom (33) towards the bale (2) and with its opening (32) away from the bale (2). The bottom (33) meets at first the bale (2) with its outer side during the relative motion between the stretching frame (18)

and the bale (2) and the expansion cap (4) is folded over and turned during the further motion. The cap opening (32), which was originally on top, lies at the bottom at the end of the pull-up and pull-over motion. The reefed jacket area (34, 35) is gradually pulled off downward from the stretching frame (18) during the relative motion and deflected by 180° at the lower edge of the stretching frame or the rolling or turning edge located there as well as laid, while shrinking, onto the side wall of the bale.

When pulling over the expansion cap (4), the distance between the stretching frame (18) and the sides of the pressed bale (2) can be selected to be very short. As a result, the expansion cap (4) can be placed on the pressed bale (2) with a great residual expansion and stronger contact forces that result from this, which is advantageous for the durability of the packaging. The side walls (34) of the expansion cap (4) are led around the stretching frame (18) during the entire pull-over operation and can also be placed at the end of the pull-over operation with the material edges on the pressed bale, which makes possible a controlled longitudinal stretching of the cap material over the entire lateral contact area. Uncontrolled snapping on of the expansion cap (4) at the end of the pull-over operation can be prevented from occurring, which makes possible a higher accuracy in positioning the expansion cap.

The packaging device (1) can surround the pressed bale (2) with a single expansion cap (4) in the simplest variant, and at least a partial area of the pressed bale (2) remains uncovered or free.

As an alternative, the packaging device (1) makes it possible to form a complete envelope or wrapping (26) of the pressed bale (2). The envelope (26) may comprise a plurality of expansion caps (4), which are placed around the pressed bale (2) from different, e.g., opposite sides and with mutual overlap. As an alternative, the pressed bale (2) may already have a partial envelope (11), e.g., a bottom film, which tightly surrounds the bottom and the adjoining side walls up to a certain height. This partial envelope (11) will be explained in detail below.

If the pressed bale (2) is to be packed into a plurality of expansion caps (4), the packaging device (1) has a turning means (21) for pressed bales (2). The turning means (21) may have different designs and, e.g., turn the pressed bale (2) on the bale pickup (20) once or several times and optionally in different directions.

In the exemplary embodiment being shown, the turning means (21) has a different design for reasons of time and capacity and comprises a conveyor (22), which surrounds the packaging device (1) and has an essentially U-shaped design, and it is connected with its ends in front of and behind the packaging device (1) to a conveyor (13) located there. One or more tilting devices (23) for a pressed bale (2) are arranged at conveyor (22), which said tilting devices (23) are located, e.g., at the corner points of the conveyor (22) and tilt the pressed bale (2) arriving from one conveyor strand there and tilt it onto the next conveyor strand adjoining at an angle. FIG. 1 shows this arrangement and illustrates the direction of circulation by arrows. The turned pressed bale (2) is again transported as a result to the inlet of the packaging means (1) and can subsequently be provided with a second and optionally additional expansion caps (4) on another side of the bale, especially on its free side not covered by the first expansion cap (4) or underside.

As is shown in the top view in FIG. 1, the one or more baling presses (6) are connected by a conveying means (7) with the packaging device (1). The conveying means (7) may have any desired and suitable design. Parallel discharging conveyors (8), which have an unloading device (12) for removing bales from the baling press (6) at one end and are connected to a transverse conveyor (9) at the other end, are arranged at the baling presses (6) arranged next to each other in a row in the embodiment being shown. The transverse conveyor (9) forms a kind of shunt conveyor and is in turn connected to a conveyor (13), with which the pressed bales (2) are transported to the packaging device (1) and from there farther to a discharge station or the like. The conveyors may have any desired and suitable design. The transport and conveying area between the baling presses (6) and the packaging device (1) is called feed area (24) and extends into the devices (1, 6).

Figure 2:
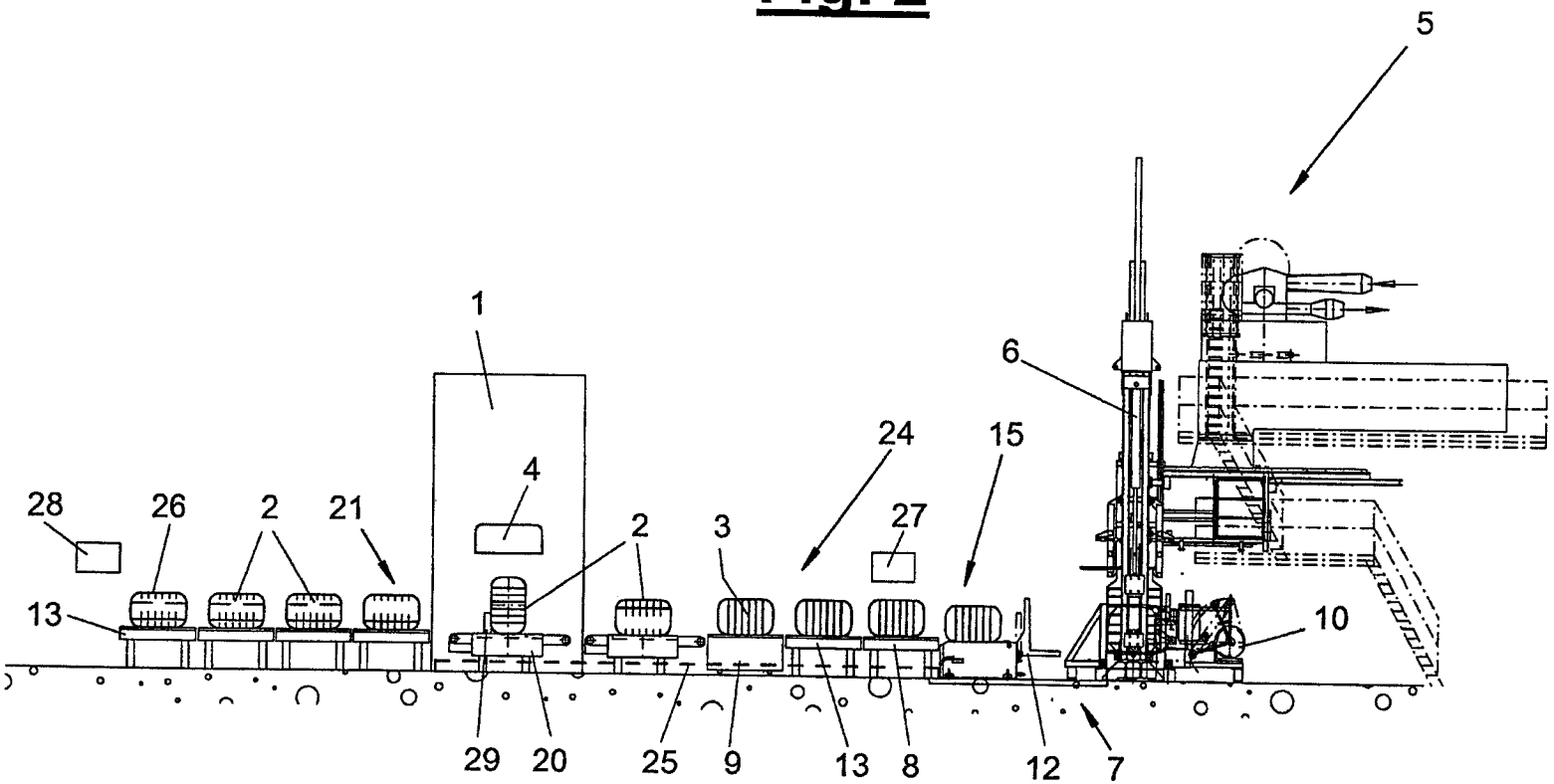
FIG. 2 is a schematic side view, according to arrow II in FIG. 1, of a baling press plant with a plurality of baling presses and with a common packaging device.

As is illustrated in a schematic side view in FIG. 2, a monitoring means (27), which checks the quality of the pressed bale and possibly detects reject, may be arranged in the feed area (24). It is possible to determine as a result, in particular, whether a pressed bale (2) is not fixed sufficiently and is broken up. Such a pressed bale (2) can be removed via the conveying means (7). It may possibly also be restrapped at an auxiliary station or fixed in another manner. Other reasons for rejects can also be eliminated in such an auxiliary station (not shown).

Another monitoring means (28), which checks the quality of packaging and especially determines whether one or more expansion caps (4) close tightly around the pressed bale (2) or whether they are broken up or cut open, may be arranged behind the packaging device (1). The pressed bale (2) can be returned in such a case into the feed area (24) via a suitable auxiliary conveyor (not shown) and fed again to the packaging device (1).

If different bale materials, which are to be kept uncontaminated with one another for reasons of quality, are processed in a single baling press (6) or in a baling press plant (5) with a plurality of baling presses (6), there may be a problem of entrainment in the feed area (24). Bale particles may become detached during the transportation of the bale due to abrasion or the like and deposited in the conveying area, where they may again be picked up by another pressed bale consisting of a different material and then form the undesired contamination or a mixing of materials. This can be counteracted by a means (15) for avoiding contamination and/or mixing of bale materials, which is preferably associated with the packaging device (1). Said means (15) may have various designs.

FIG. 2 shows a first variant, in which the means (15) has a cleaning device (25) for the feed area (24) of the pressed bales (2). The transport paths and the contact sites of the pressed bales (2), which contact sites are located there, can be kept clean with the cleaning device (25). The cleaning device (25) may contain one or more vacuum means, which are arranged at the conveying means (7) and pick up and remove there any detached bale materials, especially bale fibers. It is possible, as an alternative, to clean the components of the conveying means (7), e.g., conveyor belts, conveying rollers or the like, with brushes or other cleaning devices and to free them of bale materials.

FIG. 3 illustrates another variant of means (15). A plurality of bale carriers (14) are used in this case, which protectively take up the pressed bales (2) and are associated with the corresponding kinds of materials. This makes it possible to transport the pressed bales (2) without mutual contamination. The bale carriers (14) circulate within the plant and are brought by a suitable means from the packaging device (1) back to the conveying means (7) and into the feed area (24) after unloading the bale. The bale carriers (14) are designed, e.g., as plates or trays, which pick up a pressed bale (2) with a lateral projection and also take up any separating bale material. The conveying means (7) is protected from contamination as a result. The bale carriers (14) can be cleaned at a suitable site when needed. The pressed bales (2) remain on the bale carriers (14) until they definitively leave the packaging device (1). The bale carriers (14) can also be entrained in the area of the turning means (21).

In another variant of said means (15), the pressed bales (2) may already be provided with the partial envelope (11) mentioned in the introduction early and before being charged to the feed area (24). This may be, e.g., the said bottom envelope or bottom film, which is introduced already during the manufacturing of the bale and protectingly and tightly covers the pressed bale (2) at least on the underside and preferably also on a partial area of the adjoining side walls of the bale. The partial envelope (11) may be surrounded by the strapping or another fixing means (3) on the outside and fixed to the pressed bale (2).

To apply the partial envelope (11), the packaging device (1) has a prepackaging device (10), which is associated with one or more baling presses (6). The prepackaging device (10) may be designed, e.g., corresponding to DE 40 15 642 A1 or WO 88/09748 A1. Instead of a bottom film, a cover film may be applied as well, and the pressed bale (2) is turned before being loaded to the conveying means (7) and is aligned with the envelope (11) towards the conveying means (7).

FIG. 4 illustrates this arrangement and shows, in addition, the possibility of making do with only one expansion cap (4) to form a full envelope (26) if such a partial envelope (11) exists. If a bottom envelope (11) has been pulled up high enough, a single expansion cap (4) is sufficient, which is pulled over with an overlap. The envelope (26) is closed tightly at the overlapping site between the packaging parts (4, 11). The fixing means (3) may be located partly outside the envelope (26) in such an embodiment. Partial exposure of the strappings or other fixing means (3) may be advantageous for the later opening. The strappings are still surrounded to a large part by the expansion cap (4) and are fixed as a result in a large area, as a result of which the strappings are prevented from opening up suddenly and flying off, which may be a source of accidents.

Various modifications of the embodiments shown and described are possible. The packaging device (1) may have a different design and be positioned at a different site. The expansion caps (4) may be produced and supplied in a different way. The expansion caps (4) may also be applied to the pressed bales (2) in a different way. However, the pulling over in the manner described does have the advantage that the weld seam on the bottom of the cap is located on the inner side and is turned towards the pressed bale (2). As a result, it is secured against adverse outside effects. Furthermore, the baling presses (6) may have any other desired and suitable design and be arranged in any other desired and suitable manner. The kinematics of the relative motion of the pressed bale (2) and expansion cap (4) may be varied by both being moved relative to one another during the application of the cap or, as an alternative, by the pressed bale (2) being moved relative to the nonmoving expansion cap (4) and the nonmoving stretching frame (18). The material of the expansion cap may also be varied and the expansion cap does not have to be a plastic film.

While specific embodiments of the invention have been described in detail to illustrate the application of the principles of the invention, it will be understood that the invention may be embodied otherwise without departing from such principles.

The invention claimed is:

1. A baling press plant comprising:

at least one baling press for producing highly compacted pressed bales provided with a fixing means which imparts a permanent shape to the highly compacted pressed bales and prevents the pressed bales from opening up before a subsequent packaging; and a packaging device for packaging the pressed bales, wherein the packaging device comprises a pull-over means for applying at least one elastic material expansion cap, which is prepared in advance of a predetermined cap size and cut to length, wherein the predetermined cap size provides a cap expanded state larger than dimensions of the highly compacted pressed bales and with a cap released state of a size to contact bale surfaces, of the highly compacted pressed bales, in a pulled over cap position, wherein the pull-over means has a movable and adjustable stretching frame for expanding the elastic material expansion cap from the cap released state to the cap expanded state and pulling the elastic material expansion cap, in the expanded state, over the pressed bale and releasing the elastic material expansion cap from the expanded state to the released state such that the elastic material expansion cap comes tightly into contact with the bale surfaces in the pulled over cap position.

2. A baling press plant in accordance with claim 1, wherein the packaging device has a bale pickup for picking up pressed bales.

3. A baling press plant in accordance with claim 1, wherein the pull-over means turns the expansion cap during application to the pressed bale.

4. A baling press plant in accordance with claim 1, wherein the expansion cap is arranged at the pull-over means with a closed bottom of the expansion cap positioned towards the pressed bale.

5. A baling press plant in accordance with claim 1, wherein the expansion cap is arranged at the pull-over means with a cap opening positioned towards the pressed bale.

6. A baling press plant in accordance with claim 1, wherein the expansion cap is disposed extending around the stretching frame during pulling over and reverses a position of a closed bottom and a cap opening as the expansion cap turns from inside out to outside out.

7. A baling press plant in accordance with claim 1, wherein the expansion cap is pulled over the pressed bale by a vertical relative motion.

8. A baling press plant in accordance with claim 1, wherein the expansion cap has a size that is essentially shorter than the length of the pressed bale in the direction in which the expansion cap is pulled over.

9. A baling press plant in accordance with claim 1, wherein a single expansion cap incompletely surrounds the pressed bale on at least one side.

10. A baling press plant in accordance with claim 1, wherein the pressed bale is not moving during an enveloping operation.

11. A baling press plant in accordance with claim 1, further comprising a bale pickup with a stabilizing means for pressed bales.

12. A baling press plant in accordance with claim 1, wherein the pull-over means has a manufacturing device for manufacturing the expansion cap from a stretchable tubing or a stretched tubing.

13. A baling press plant in accordance with claim 12, wherein the manufacturing device has a means for pulling off and handling the tubing as well as a cutting and welding means for forming the cap.

14. A baling press plant in accordance with claim 1, wherein the pull-over means has movable fingers for opening and transferring the opened expansion cap to the stretching frame.

15. A baling press plant in accordance with claim 14, wherein the fingers transfer the opened expansion cap to the stretching frame.

16. A baling press plant in accordance with claim 1, further comprising a turning means for turning the pressed bale.

17. A baling press plant in accordance with claim 1, wherein the pull-over means applies a plurality of expansion caps to the pressed bale from different sides.

18. A baling press plant in accordance with claim 1, wherein the pull-over means applies a closed envelope to the pressed bale.

19. A baling press plant in accordance with claim 1, further comprising a means for avoiding contamination and/or mixing of bale materials.

20. A baling press plant in accordance with claim 1, further comprising a cleaning device for a feed area of the press bales.

21. A baling press plant in accordance with claim 1, further comprising a plurality of movable hall bale carriers specific of a particular kind of material.

22. A baling press plant in accordance with claim 1, further comprising at least one baling press and a connected conveying means.

23. A baling press plant in accordance with claim 1, further comprising a prepackaging device, which provides the pressed bale with a partial envelope before or after fixation of the bale with the fixing means.

24. A baling press plant in accordance with claim 23, wherein the prepackaging device applies a bottom envelope as the partial envelope to the pressed bale before fixation, and before strapping.

25. A baling press plant in accordance with claim 1, further comprising at least one monitoring means for monitoring the pressed bale and/or the packaging thereof.

26. A baling press plant in accordance with claim 1, further comprising at least one additional baling press wherein a plurality of baling presses are provided, each of the plurality of baling presses being connected to the packaging device wherein the plurality of baling presses feed only the packaging device.

27. A baling press plant in accordance with claim 26, further comprising a conveying means for conveying pressed bales wherein the packaging device is connected to the plurality of baling presses by the conveying means for pressed bales.

28. A baling press plant in accordance with claim 1, wherein the packaging device is integrated within the baling press.

29. A baling press plant in accordance with claim 1, wherein:

the packaging device has a bale pickup for picking up pressed bales;

the pull-over means turns the expansion cap, from inside out to outside out, during application to the pressed bale; and the expansion cap is arranged at the pull-over means with a closed bottom positioned towards the pressed bale.

30. A process comprising the steps of:

forming highly compacted pressed bales in a baling press including providing each of the highly compacted pressed bales with a fixing means which imparts a permanent shape to the highly compacted pressed bales and prevents the highly compacted pressed bales from opening up before a subsequent packaging;

providing elastic material expansion caps of a predetermined cap size, wherein the predetermined cap size provides a cap expanded state, with a cap expanded state size that is larger than dimensions of the highly compacted pressed bales, and with a cap released state, with a cap released state size that provides contact between an inner surface of the cap and adjacent bale surfaces, of the prepackaged bales, in a pulled over cap position; and applying two expansion caps, to each of the highly compacted pressed bales, by means of a pull-over means, wherein the pull-over means has a movable and adjustable stretching frame for stretching the elastic material expansion caps from the cap released state to the cap expanded state and pulls the elastic material expansion caps, in the expanded state, over the pressed bale and releases the elastic material expansion caps from the expanded state to the released state such that the elastic material expansion caps each come tightly into contact with the bale surfaces in the pulled over cap position and overlap each other in an overlap region.

31. A process in accordance with claim 30, wherein the expansion cap is turned from the inside to the outside and rolls on the bale during application to the pressed bale.

32. A process in accordance with claim 30, wherein during the step of applying, the pressed bale is maintained in a position and a first expansion cap is moved relative to the pressed bale.

33. A process in accordance with claim 30, wherein the pressed bale is turned after application of a first expansion cap and is enveloped with another expansion cap on the free side.

34. A process in accordance with claim 30, wherein the pressed bales are transported in a contamination-free manner on bale carriers for specific kinds of materials.

35. A process comprising the steps of:

forming highly compacted pressed bales in a baling press including providing each of the highly compacted pressed bales with a fixing means which imparts a permanent shape to the highly compacted pressed bales and prevents the highly compacted pressed bales from opening up before a subsequent packaging and forming prepackaged bales in the baling press by applying one of a top and bottom packaging film at a bale top or a bale bottom and on a portion of adjoining side walls;

providing elastic material expansion caps of a predetermined cap size, wherein the predetermined cap size provides a cap expanded state, with a cap expanded state size that is larger than dimensions of the prepackaged bales, and with a cap released state, with a cap released state size to provide contact between an inner surface of the cap and adjacent prepackaged bale surfaces, of the prepackaged bales, in a pulled over cap position; and applying a single expansion cap, to each of the prepackaged bales, by means of a pull-over means, wherein the pull-over means has a movable and adjustable stretching frame for stretching the elastic material expansion cap from the cap released state to the cap expanded state and pulls the elastic material expansion cap, in the expanded state, over the prepackaged bale and releases the elastic material expansion cap from the expanded state to the released state such that the elastic material expansion cap comes tightly into contact with the prepackaged bale surfaces in the pulled over cap position.

36. A process in accordance with claim 35, wherein the expansion cap is turned from the inside to the outside and rolls on the bale during application to the pressed bale.

37. A process in accordance with claim 35, wherein during the step of applying, the pressed bale is maintained in a position and the first expansion cap is moved relative to the nonmoving pressed bale.

38. A process in accordance with claim 35, wherein the single expansion cap covers all surfaces of the bale that are not covered by the one of the top and the bottom packaging film of the prepackaged bales.

* * * * *